US008487970B2

(12) United States Patent
Stowe et al.

(10) Patent No.: US 8,487,970 B2
(45) Date of Patent: Jul. 16, 2013

(54) DIGITAL IMAGING OF MARKING MATERIALS BY THERMALLY INDUCED PATTERN-WISE TRANSFER

(75) Inventors: Timothy D. Stowe, Alameda, CA (US); Eugene M. Chow, Fremont, CA (US); Ashish V. Pattekar, Cupertino, CA (US); Eric Peeters, Fremont, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 1285 days.

(21) Appl. No.: 12/245,578

(22) Filed: Oct. 3, 2008

(65) Prior Publication Data

US 2010/0085585 A1 Apr. 8, 2010

(51) Int. Cl.
*B41J 2/315* (2006.01)

(52) U.S. Cl.
USPC ..... 347/171

(58) Field of Classification Search
USPC ..... 347/171, 187, 103, 213, 221, 229, 347/232, 233, 234; 430/200; 358/518
See application file for complete search history.

(56) References Cited

U.S. PATENT DOCUMENTS

| | | | |
|---|---|---|---|
| 2,800,699 | A | 8/1955 | Armstrong |
| 3,655,379 | A | 4/1972 | Gundlach |
| 3,741,118 | A | 6/1973 | Carley |
| 3,798,365 | A | 3/1974 | Browning et al. |
| 3,986,874 | A | 10/1976 | Marsh |
| 4,080,897 | A | 3/1978 | Gundlach |
| 4,400,412 | A | 8/1983 | Scanlon et al. |
| 4,462,035 | A | 7/1984 | Koto |
| 4,838,940 | A | 6/1989 | Kan et al. |
| 4,945,833 | A | 8/1990 | Arahara et al. |
| 4,962,389 | A | 10/1990 | Kan et al. |
| 4,972,200 | A | 11/1990 | Arahara et al. |
| 5,017,223 | A | 5/1991 | Kobayashi et al. |
| 5,019,835 | A | 5/1991 | Arahara et al. |
| 5,032,849 | A | 7/1991 | Arahara et al. |
| 5,041,843 | A | 8/1991 | Tohyama et al. |
| 5,084,716 | A | 1/1992 | Koumura et al. |
| 5,100,468 | A | 3/1992 | Yuasa et al. |
| 5,132,706 | A | 7/1992 | Yuasa et al. |
| 5,142,306 | A | 8/1992 | Arahara et al. |

(Continued)

FOREIGN PATENT DOCUMENTS

| | | |
|---|---|---|
| CA | 2404328 | 9/2002 |
| DE | 10106415 A1 | 9/2002 |

(Continued)

OTHER PUBLICATIONS

European Patent Office Search Report dated Mar. 4, 2010, The Hague, Netherlands.

(Continued)

*Primary Examiner* — Kristal Feggins
(74) *Attorney, Agent, or Firm* — Marger Johnson & McCollom PC

(57) ABSTRACT

An imaging system including an image receiving structure including a material layer having a tunable energy transfer characteristic; and an energy source to emit an energy beam at the material having the tunable energy transfer characteristic such that marking material is pattern-wise transferred to the image receiving structure.

An imaging system includes an image receiving structure disposed to be in direct contact with marking material; and an energy source to emit a pattern-wise modulated energy beam at a region of the image receiving structure contacting the marking material to pattern-wise transfer marking material to the image receiving structure.

16 Claims, 6 Drawing Sheets

U.S. PATENT DOCUMENTS

| | | | |
|---|---|---|---|
| 5,143,546 | A | 9/1992 | Yuasa et al. |
| 5,151,712 | A | 9/1992 | Arahara et al. |
| 5,175,568 | A | 12/1992 | Oyamaguchi et al. |
| 5,177,506 | A | 1/1993 | Katano |
| 5,227,265 | A | 7/1993 | DeBoer et al. |
| 5,249,000 | A | 9/1993 | Okabe et al. |
| 5,262,374 | A | 11/1993 | Okabe et al. |
| 5,436,642 | A | 7/1995 | Oyamaguchi et al. |
| 5,471,234 | A | 11/1995 | Katano et al. |
| 5,666,598 | A | 9/1997 | Sugita et al. |
| 5,942,094 | A | 8/1999 | Castegnier et al. |
| 6,045,674 | A | 4/2000 | Castegnier |
| 6,056,388 | A | 5/2000 | Maximovsky et al. |
| 6,090,257 | A | 7/2000 | Castegnier et al. |
| 6,108,021 | A | 8/2000 | Morikawa et al. |
| 6,161,928 | A | 12/2000 | Morikawa et al. |
| 6,270,194 | B1 | 8/2001 | Maximovsky et al. |
| 6,330,857 | B1 | 12/2001 | Maximovsky et al. |
| 6,356,289 | B1 | 3/2002 | Tomita et al. |
| 6,387,588 | B1 | 5/2002 | Katano et al. |
| 6,396,528 | B1 | 5/2002 | Yanagawa |
| 6,725,777 | B2 | 4/2004 | Katano |
| 2003/0156178 | A1 | 8/2003 | Lehmann |
| 2005/0212888 | A1 | 9/2005 | Lehmann et al. |
| 2007/0273941 | A1 | 11/2007 | Ito |

FOREIGN PATENT DOCUMENTS

| | | |
|---|---|---|
| EP | 0292938 | 11/1988 |
| EP | 0322903 | 7/1989 |
| GB | 2194756 | 3/1988 |
| WO | WO0172518 | 4/2001 |

OTHER PUBLICATIONS

S. L. Gaudioso, J. H. Becker, and D. S. Sypula, "Mechanisms of Ink Release in Waterless Lithography," TAGA Proceedings, Taga Office, 1975. p. 177-194.

O. Homburg, D. Hauschild, F Kubacki, V. Lissotschenko, "Efficient beam shaping for high-power laser applications" Laser Source and System Technology for Defense and Security II, SP Proceedings of SPIE—vol. 6216, May 2006.

Bird, Stewart and Lightfoot, "Transport Phenomena, 2nd Edition", Chapter 1.5 The Molecular Theory of the Viscosity of Liquids, John Wiley & Son, New York, pp. 29-31.

Vad. I. Surikov et. al. "Specific heat and magnetic susceptibility of vanadium dioxide." Soy. Phys. Solid State 29(2), 1987, p. 351.

I.R. McNab and William R. Gass. "High-Current Density Carbon Fiber Brush Experiments in Humidified Air and Helium" IEEE Transactions on Components, Hybrids, and Manufacturing Technology, vol. CHMT-3, No. 1, Mar. 1980, pp. 26-30.

Philip Reichner. "Metallic Brushes for Extreme High-Current Applications," IEEE Transactions on Components, Hybrids, and Manufacturing Technology, vol. CHMT-3, No. 1, Mar. 1980, pp. 21-26.

F. C. Case, "Improved Vo2 thin Films for Infrared Switching," Applied Optics vol. 30, No. 28, pp. 4119-4123 (1991).

Braudy, "Laser Writing," Proceedings of the IEEE, pp. 1771-1772 (1969) (RCA Labs).

D. Young et al. "Plume and Jetting Regimes in a Laser Based Forward Transfer Process as Observed by Time-Resolved Optical Microscopy" Mat. Res. Soc. Symp. Proc. vol. 698 (2002).

"Photoinduced Reversible Change on Wettability on PhotoChromic Polymer Surface," Japanese J. of Polymer Science and Technology, vol. 37, No. 4 (1980) pp. 287-291.

"Studying the Possibility of Aplying the Light-Hydraulic Effect to Digital Printing" L.K Vodop yanov. P.S. Kozlov, I.V. Kucherenko, S.N. Maksimovskii, G.A. Radutskii, Instruments and Experimental Techniques, vol. 46, pp. 549-553.

DIGITAL IMAGING OF MARKING MATERIALS BY THERMALLY INDUCED PATTERN-WISE TRANSFER

BACKGROUND

This disclosure relates to imaging systems and, in particular, to imaging systems for transferring marking material through pattern-wise heating.

Printing technologies fall into two distinct groups: those that are digital and allow every printed page to contain variable text and images and those that are master plate based and allow high volume duplication of a single image. Common examples of digital printing technologies include inkjet, electrophotography (EP), and thermal transfer. Common examples of master based duplications technologies include offset lithography, flexography, and gravure.

Unfortunately, all of the digital printing technologies are severely limited in speed as compared to the master based duplication processes. This speed limitation reduces their productivity and fundamentally limits their economics to copy run lengths no larger than a few hundred copies. In the case of ink jet printing, inks consist of very dilute pigments or dyes in a solvent containing and print speed is limited by energy require for solvent evaporation. In the case of electrophotography, print speed is limited by the energy required for toner fusion. Finally, the print speed for thermal transfer is limited by the energy that is required to transform inked material on a ribbon from either a solid into a liquid or for the case of dye diffusion thermal transfer (D2T2), the energy from a solid to a gas. A large amount of energy is required for these thermal methods because the ink must be raised above a phase change temperature and the latent heat of melting or evaporation must be delivered. In addition to these considerations, the lower pigment concentration of typical digital marking materials leads to higher marking pile height. This is undesirable in terms of gloss uniformity, tactile feel, stacking thickness for books, and fold fastness. Furthermore, each of the digital marking materials usually has a much stricter limitation on color gamut and substrate latitude and size when compared with offset lithography.

Unlike the digital printing technologies mentioned above, lithographic offset printing uses very high viscosity inks in the range of 100,000 cp and above. In addition, these inks have high pigment loading with very little pile height. Very little energy is needed to fix these inks to paper such that very high production speeds can be achieved without excessively large drying ovens. In offset lithography a master plate is created which has hydrophilic and hydrophobic imaging regions. Such a plate is prepared off line and then mounted onto an imaging cylinder by wrapped it around the outside surface under tension. A fountain solution, often based on water, is first applied to this plate and selectively wets the hydrophilic regions. The imaging plate then comes in contact to a donor roller which provides a blanket layer of offset ink. The areas of the master plate wetted by the fountain solution reject the offset ink from the donor roller. These non-image regions are able to repel transfer of the offset inks due to hydrophobic nature of offset inks as well as the shear forces of the nip region which induce film splitting within the fountain solution. Once the master plate is selectively inked in the hydrophobic imaging regions, this inked image is then transferred to a rubbery offset cylinder which comes in contact with a printed substrate such as paper.

Another variation off lithography offset printing is waterless offset printing. In waterless offset technologies, the master is composed of a patterned polydimethylsiloxane (PDMS) layer, commonly referred to as silicone, used to block the transfer of ink. That is, silicone is used to prevent the transfer of the ink. Under the rapid shearing forces of the NIP, the viscoelastic cohesive forces within the ink can exceed the surface adhesion force at the silicone interface and the ink peels off from the non-image areas of the cylinder in a manor similar to a sticky yet elastic rubber like material. The adhesion force of the silicone interface is further reduced by the fact the silicone surface forms a "weak boundary layer" with solvents which diffuse into it and this promotes film splitting at the silicone interface. This behavior is amplified as the printing speed is increased because the shear forces act over a time scale faster than the inks can plastically deform. In non-silicone regions the adhesive forces overcome the built-in cohesive forces of the ink and the ink film splits apart thus leaving behind a layer of ink in the imaging areas.

In most conventional and waterless offset printing systems, the ink splitting between the donor and imaging plate and the imaging plate and the offset roller is approximately 50/50. In practical terms, this means that roughly 10 blank pages are need to remove enough ink from the offset cylinder so that the previous image is no longer visible. Thus these splitting dynamics lead to image ghosting when a new lithographic master plate mounted. Thus the ink splitting dynamics preclude lithographic technologies from achieving variable data short run printing jobs without significant image ghosting. However most offset printed jobs are long run and image ghosting does not significantly impact productivity as more make ready paper is needed to tune the alignment of each master plate corresponding to each color separated image.

Because of this issue and other issues with high viscosity inks, there have only been a few attempts at high quality high speed variable data digital printing with higher pigment concentration inks. Gravure and flexography inks with viscosities in the range of 50-1000 cp have been shown to respond to electrostatic pulling over short distances. However, the electrostatic forces are too weak to work with high viscosity high pigment concentration offset inks with viscosities above 100,000 cps.

Currently, no imaging technology exists that can print highly viscoelastic marking materials such as offset or waterless offset inks (i.e. marking materials having dynamic viscosities of 10,000-1,000,000 cps) in a digital fashion with variable data on each and every page.

DETAILED DESCRIPTION

Embodiments will be described with reference to the drawings. Embodiments allow the formation of pattern-wise image by selective heating of marking material in the nip between the donor structure and image receiving structure.

A siloxane, such as silicone, also referred to as polydimethylsiloxane (PDMS), normally repels viscoelastic marking materials. Viscoelastic marking materials include waterless offset inks that are currently used in short run offset presses such as the waterless offset machines currently manufactured by Presstek, Inc. based in New Hampshire. Viscoelastic marking materials are different from most marking materials in that they have a complex elastic modulus where both elasticity and viscosity (i.e. G' and G") both play a substantial roll in determining the marking material rheology.

The internal cohesive energy of these marking materials can be made much larger than the adhesion energy to the surface of silicone. As a result, the marking materials can be presented to a silicone surface and quickly shear removed off of a silicone surface with near 100% efficiency. However, by heating such marking materials, their viscosity and internal cohesive forces (or tack) can temporarily be lowered enough to allow them to temporarily pattern-wise adhere to a silicone surface. Once on the silicone, such images can be transferred with near 100% efficiency to almost any substrate as long as the substrate has higher adhesion strength than the silicone. As a result, a non-ghosting variable data offset transfer process can be realized using waterless offset inks or other viscoelastic marking materials.

While waterless offset inks generally do not stick to silicone, heating waterless offset inks above their intended temperature range for use, these inks will readily stick to a silicone layer. In some cases as little as about a 40 degree temperature rise allows the waterless ink to go from a condition of 0% transfer coverage on to silicone to a full 100% transfer to silicone. One of the reasons that waterless offset systems must control the temperature to within a few degrees is to overcome such effects which can sometimes lead to the over toning of plates due to friction associated heating. Although this effect is undesirable in some applications, it can be used advantageously to transfer marking materials.

Figure 1:
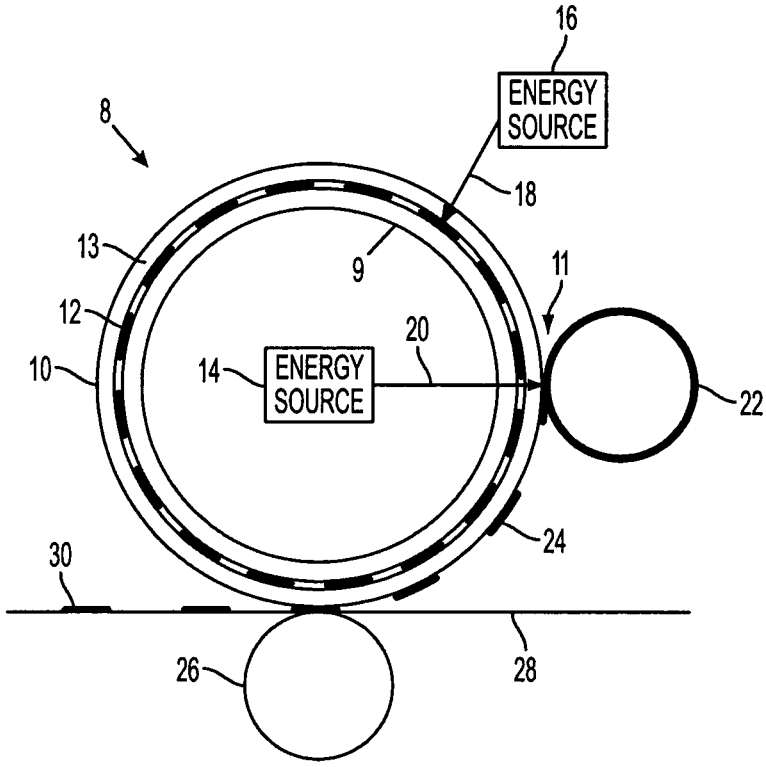
FIG. 1 is a diagram illustrating an imaging system having a tunable energy transfer characteristic according to an embodiment.

FIG. 1 is a diagram illustrating an imaging system having a tunable energy transfer characteristic according to an embodiment. In an embodiment, the imaging system 8 can pattern-wise heat marking material and selectively transfer it to an image receiving structure 10 using an mask layer 12 made from a power tolerant high speed tunable masking material.

In an embodiment, the imaging system 8 includes a donor structure 22, an image receiving structure 10 to receive marking material in an image-wise manner, a first energy source 16, and a second energy source 14. The image receiving structure 10 is defined as the structure having a surface onto which an image of a layer of marking material is first formed and then transferred to a substrate 28. The image receiving structure 10 can include materials forming the tunable mask layer 12 deposited over a supporting substrate 9. In the embodiment shown in FIG. 1 this supporting substrate 9 includes a transparent hollow drum. The donor structure 22 is configured to receive a substantially uniform layer of marking material. Forming rollers, anilox rollers, doctor blades, or the like can all be used to form the marking material on the donor structure 22. In this embodiment, a substantially uniform layer of marking material is desired. Thus, any forming, conditioning, or the like to create such a layer of marking material can be used. As a result, when the marking material enters a nip 11 as the donor structure 22 moves, a substantially uniform layer of marking material enters the nip 11.

As described above, viscoelastic waterless offset inks can be used as marking materials. However, a marking material is not limited to inks. Marking materials can be any material that has heat dependent internal cohesive characteristics. In particular, any material that has internal cohesive characteristics that decrease when an amount of heat is applied can be used as a marking material. For example, marking materials can include highly viscoelastic gel materials, viscoelastic wax based materials, low melt toners, or any other highly non-linear viscoelastic marking materials.

The image receiving structure 10 can be a multi-layer surface. The image receiving structure 10 includes a tunable mask layer 12 and an outer marking material receiving layer 13. The outer layer 13 is made from a material which selectively allows the marking material to stick to it when the marking material is sufficiently changed in viscosity or tack due to an image wise change in temperature. As discussed earlier, in one embodiment this outer layer 13 could be made from silicone which can selectively allow transfer onto this layer if waterless offset inks are heated.

In an embodiment, the outer layer 13 is disposed over the mask layer 12. However, the functional material making up the mask layer 12 could also be incorporated into the outer layer 13. For example, the mask layer 12 can be formed by a dispersion of nanoparticle material in the outer layer 13 if the nanoparticle material does not greatly change the surface wetting properties of the outside surface of the outer layer 13. Under this arrangement the mask layer 12 and image receiving structure 10 can be realized in one layer of coated material.

The mask layer 12 consists of a material having a tunable energy transfer characteristic, i.e. it functions as a tunable masking layer that can selectively change optical energy transfer characteristics such as reflectance, absorbance, transmittance, or the like based upon what state or phase the material exists in. The state of such a tunable masking material can be tuned by applying energy of a different modality such as electrical or thermal energy, by apply optical energy of a different optical wavelength range that the range the masking layer is working over, or the like to allow selective reflection, absorption, or transmission of energy.

Although the mask layer 12 has been described as being composed of the phase change material, the phase change material can, but need not form the entire mask layer 12. For example, in an embodiment, the phase change material can be dispersed throughout another material to form the mask layer 12. In another embodiment, another material can contain the phase change material to the mask layer 12.

Such a phase change tunable masking material could include thermochromic and photochromic materials such as nanocrystalline vanadium dioxide ($VO_2$). $VO_2$ can be used because of its high power tolerance, fast switching time, high contrast ratio in the near and mid infrared, and low power levels required for switching. $VO_2$ has also been shown to be reliable rewriteable as a data storage medium. In another example, chalcogenide materials such as materials based on germanium-antimony-tellurium (GST) chalcogenide materials can also be useful to create a high speed tunable infrared mask. Such chalcogenide materials are currently used in rewritable DVD players and have been shown to have long archival lifetimes and 1E8 rewrite cycles. In another embodiment, the mask layer 12 can include materials such as electro-optic liquid crystals.

In an embodiment, the masking layer 12 can be made relatively thin (i.e. <500 nm). Thus the mask layer 12 can be rapidly be tuned with a lower power from the first energy source 16 while the second energy source 14 can have a higher power, but does not need to be directly modulated at high speed since the mask layer 12 accomplishes the pattern-wise modulation of this power.

In another embodiment, the material for the mask layer 12 can be selected to have a memory that is persistent over multiple cycles. For example, the mask layer 12 can remain in a tuned state until it is rewritten by the first energy source 16. This allows a pattern in the mask layer 12 to be formed once and reused for multiple image copies.

In an embodiment, the imaging surface 10 can be formed onto a drum 9. The drum 9 can be a supporting substrate composed of glass or other transparent material. The deposition of the mask layer 12 on a cylindrical glass drum can be performed with drum sputtering systems designed for large area batch sputtering of flexible substrates. The outside image receiving layer material 10 can then be coated over mask layer 12. Under this alternative configuration, the mask layer 12 can be sputtered on a flexible optically transparent dielectric thin film substrate such as polyimide or mylar. Localized rapid laser annealing can be used to transform the sputtered amorphous $VO_2$ to a crystalline form that exhibits the phase change tunable energy transfer characteristics.

The outer layer 13 is disposed over the mask layer 12 and disposed between the mask layer 12 and the donor structure 22. This outer layer 13 can be a siloxane layer such as silicone as described above. Other low surface energy materials such as copolymer chains of siloxane and fluorinated end groups (—CF3) may also be used. Although the outer layer 13 has been described as disposed over the mask layer 12, the outer layer 13 can, but need not be in direct contact with the mask layer 12. That is, there can be intervening layers, structures, or the like. In addition, as described above, the functional material making up the mask layer 12 could also be incorporated into the material of the outer layer 13. For example, if a dispersion of nanoparticle-based phase change masking material does not greatly change the surface wetting properties of the outside surface of the outer layer 13, such a nanoparticle-based material can be incorporated in the outer layer 13.

The first energy source 16 is configured to emit a first energy beam 18 at the mask layer 12 to pattern-wise tune the energy transfer characteristic of the material of the mask layer 12. The second energy source 14 is configured to emit a second energy beam 20 at the mask layer 12. A purpose of the first energy source 16 is to tune the optical state of mask layer 12. A purpose of the second energy source 14 is to deposit optical energy in a narrow line fashion over mask layer 12, which then selectively reflects, absorbs, or transmits this energy based upon the tuned state of the mask layer. Thus, the temperature profile of the surface 10 is then image-wise realized. As used in this disclosure, the first energy source 16 is any device, apparatus, system, or the like that can emit thermal energy, microwave energy, optical energy, or the like. For example, the first energy source can be heating elements, masers, lasers, or the like.

In an embodiment, the first energy source 16 can be a high power LED array situated outside the image receiving drum. In another embodiment, the first energy source can be a raster scanned high power diode laser. Although the first energy source 16 is illustrated as outside of the image receiving structure 10, the first energy source 16 can be disposed wherever it can pattern-wise tune the mask layer 12. For example, the first energy source 16 can be disposed within the image receiving structure 10. Accordingly, the first energy beam 18 can pass through a back surface of the image receiving structure 10 to tune the mask layer 12.

The second energy source 14 can also be any device, apparatus, system, or the like that can emit thermal energy, microwave energy, optical energy, or the like. In an embodiment, the second energy source 14 can be a compact high power laser line source. Line generated laser patterns can be efficiently created using a specially designed imaging optics in combination with high efficiency diode bar arrays. In another embodiment, it is also possible to use horizontally stacked diode bar arrays with a fast axis collimation cylindrical lens and a linear holographic diffuser or microlens arrays to form a line image with reduced coherent imaging speckle. Such an optical laser line heating system efficiently heats only the nip region and can be made small enough to be placed inside the image receiving structure 10. For example, the image receiving structure 10 can include a material coated over an optically transparent drum such as a glass cylinder with the mask layer 12 sandwiched between the glass cylinder and an outer layer 13 such as a silicone.

Many different optical configurations can be used to generate the second optical energy source into the shape of a line source with a flat-top uniform profile across the width of the imaging drum. In another embodiment, an array of high power vcsels (vertical cavity surface emitting lasers) with a cylindrical lens and holographic diffuser can be used as the second energy source 14. The linear holographic diffuser can spread the laser energy out along the direction of the line and randomize the phase of the laser light for a given angle so as to reduce speckle coming from the diode bar. In addition, a polarization scrambling plate can be used to further reduce speckle. Accordingly, the second energy source 14 can emit a high power laser in a line pattern across an axis of the nip 11.

In an embodiment, the first energy beam 18 can be pattern-wise modulated to tune the state of the mask layer 12 of the image receiving structure 10. The pattern-wise modulation can include several different types of modulation used to tune the mask layer 12. For example, the first energy beam 18 can be amplitude modulated (including on-off modulation), pulse width modulated, frequency modulated, or the like. If the first energy source 16 includes one or more lasers, the lasers may be directly modulated, modulated in a master oscillator power amplifier arrangement (MOPA), modulated with an external modulator such as an acoustic optical modulator (AOM), or a total internal reflection electro-optic modulator (EOM), a MEMS optical modulator, or the like, or modulated by any other technique. Raster optical scanning may also be used direct the first energy beam 18 to different locations over the tunable mask layer 12.

Marking material is provided on the donor structure 22. As described above, the marking material can have a substantially uniform thickness. The image receiving structure 10 having underneath it a tuned mask layer 12 can be moved to be in contact with the marking material. In this embodiment, the image receiving structure 10 can be rotated such that the tuned region is moved to the nip 11. As a result, the marking material contacts the image receiving structure 10 where the mask layer has been tuned.

The second energy beam 20 can irradiate the marking material contacting the image receiving structure 10. In this embodiment, the second energy beam passes through the tuned mask layer 12. The incident radiation can heat the marking material. As described above, the marking material's viscosity and/or internal cohesiveness can change as it is heated, causing it to adhere to the surface of the image receiving structure 10. Since the tuned mask layer 12 of the image receiving structure 10 is between the second energy beam 20, and the mask layer 12 as pattern-wise tuned, the marking material in the nip 11 is pattern-wise heated. Thus, its viscosity and/or internal cohesiveness can be pattern-wise changed in the nip 11. As a result, marking material is pattern-wise transferred to the image receiving structure as transferred material 24 once the donor structure 22 and image receiving structure 10 separate at the exit of the nip.

A substrate 28 can be brought in contact with the image receiving structure 10. For example, an impression roller 26 can contact the substrate 28 to the image receiving structure 10. As the patterned marking material 24 is moved to contact the substrate 28, the patterned marking material 24 can cool, increasing its internal cohesiveness. As a result, its adhesion to the image receiving structure 10, in particular to a silicone surface of the image receiving structure 10, is reduced. Patterned marking material 30 is then transferred to the substrate. As described above, a silicone surface is normally used to repel marking materials. By pattern-wise increasing the adhesion to transfer the marking materials to the image receiving structure 10, then cooling the marking materials to reduce the adhesion, an efficient transfer of marking materials to the substrate 28 approaching 100% can be achieved. Although the patterned marking materials 24 have been described as being cooled prior to being transferred to the substrate 28, as long as the adhesion of the patterned marking materials 24 to the substrate 28, even in their lower internal cohesion state, is greater than the adhesion to the image receiving structure 10, the pattern marking materials 24 can be efficiently transferred.

In an embodiment, the marking material does not undergo a phase transition from a solid to a liquid state. In contrast, the marking material remained in a viscoelastic state even though the laser lowered the viscosity of the marking material by increasing its temperature. That is, an amount of energy was transferred to the marking material sufficient to change its viscosity, but insufficient to change its phase.

This does not mean that the energy transferred must be limited to less than that which would induce a phase change. In contrast, the mask layer 12 can be similarly used to pattern-wise heat the marking material to induce a phase change such as gel inks or solid inks.

Figure 2:
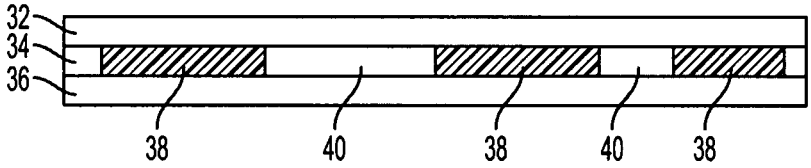
FIG. 2 is a cross-sectional view of an image receiving structure according to an embodiment.

FIG. 2 is a cross-sectional view of an image receiving structure according to an embodiment. In this embodiment, the outer layer is a silicone layer 32. The mask layer 34 is in direct contact with the silicone layer 32. The mask layer 34 has sections where the material with the tunable energy transfer characteristic has been changed to different states within the mask layer 34. For example, sections 38 illustrate where the material of the mask layer 34 has been changed into an opaque state. Sections 40 illustrate where the material of the mask layer 34 has been changed into a transparent state. Although the terms transparent and opaque have been used, the energy transfer characteristics of the sections can be as desired to pattern-wise mask the second energy beam 20 as describe above.

The mask layer 34 is formed over a supporting substrate 36. For example, the substrate 36 can be glass. Any material that has sufficient support for the mask layer and outer layer 34 and 32, and can be substantially transparent to the second energy beam 20 can be used as the substrate 36.

In an embodiment, the material having a tunable energy transfer characteristic includes a bi-stable phase change material. For example, the material can include at least one of a thermochromic material, a photochromic material, or the like.

Figure 3:
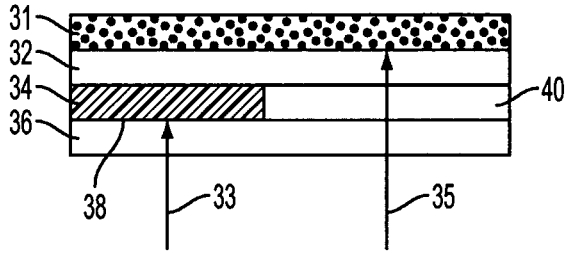
FIG. 3 is cross-sectional view of an image receiving structure illustrating energy transfer characteristics of the image receiving structure according to an embodiment.

FIG. 3 is cross-sectional view of an image receiving structure illustrating energy transfer characteristics of the image receiving structure according to an embodiment. In this embodiment, the material having the tunable energy transfer characteristic has a first transmittance in a first state and a second transmittance in a second state. The first transmittance is less than the second transmittance. For example, the mask layer 12 can be used in a high transmission/low transmission mode. Section 40 of the mask layer 34 is tuned with a high transmission mode. Section 38 is tuned with a low transmission mode. Accordingly, when an energy beam 33 is incident on section 38 having a low transmission, it is not transmitted to the marking material 31. Thus, the marking material is not heated over section 38. In contrast, energy beam 35 passes through section 40 as it has a higher transmission.

Color imaging can use multiple colors of marking materials. For example with a cyan, magenta, yellow, and key (CMYK) color model, four marking materials can be used. However, each marking material may have a different absorbance for the wavelength range of the second energy beam 20. In addition, the amount of energy needed to induce the change in viscosity can vary due to the absorption depth for different colors. Accordingly, additives can be added to the marking materials to bring the absorbencies of the marking materials together within a range so that each marking material can absorb a desired amount of energy to change the viscosity. An additive having a high degree of absorption of the second energy beam 20 can be added to the marking materials. For example, infrared resonant absorbing dyes or pigments can be added to absorb the second energy beam 20.

In another embodiment, energy absorbing pigments can be added into the outer layer of the image receiving structure 10. For example, carbon black can be added to the outer layer 32 that can directly contact the marking material 31. As a result, an amount of energy can be added to the marking materials to change the viscosity regardless of color.

In an embodiment, an absorbance of the mask layer 34 in one wavelength range can be independent of the transmission state of the mask layer 34 over a different wavelength range. For example, as described above, the mask layer 34 can have either a high or low transmittance depending on the state of the mask layer 34. The difference in the transmittance may occur over a certain laser wavelength range used to selectively heat the nip region. However, over a different wavelength range, the mask layer 34 can be substantially absorptive regardless of state. By selecting the first energy source 16 so that the first energy beam 18 has a wavelength range within the range over which the mask layer 34 is substantially absorptive regardless of state, the first energy beam 18 can be absorbed to tune the state of the material regardless of the previous state of the mask layer 34.

Figure 4:
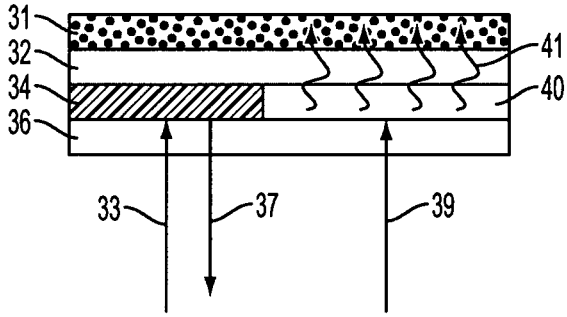
FIG. 4 is cross-sectional view of an image receiving structure illustrating energy transfer characteristics of the image receiving structure according to another embodiment.

FIG. 4 is cross-sectional view of an image receiving structure illustrating energy transfer characteristics of the image receiving structure according to another embodiment. Similar to FIG. 3, section 38 of the mask layer 34 is tuned in a first state. Section 40 is tuned in a second state. Section 38 has a first absorbance and a first reflectance in the first state. Section 40 has a second absorbance and a second reflectance in the second state.

Energy beam 33, incident on section 38, results in reflected energy beam 37. In contrast, energy beam 39 is not reflected back, or it is reflected less than reflected energy beam 37. The first reflectance of section 38 is higher than the second reflectance of section 40. Accordingly, less energy is available to be transmitted or absorbed by section 38 than section 40.

In addition to the reflectance, the first absorbance is less than the second absorbance. That is, the absorbance of section 38 is less than the absorbance of section 40. Accordingly, section 40 absorbs more energy than section 38. As a result, section 40 can heat up. The heat 41 is transferred to the marking material 31. Since more heat is transferred from the mask layer 34 when the material is in the second state with a higher absorbance, the marking material is pattern-wise heated according to the pattern of the mask layer 34.

In an embodiment, $VO_2$ can be used in a high absorption/high reflection-low absorption phase change mode. $VO_2$ can be nominally highly absorbing in a high temperature semi-metallic phase. In an embodiment, the energy absorbed by the mask layer 34 while heating with an energy beam 39 as described above can be less than an amount of energy needed to change a phase of the mask layer 34. In particular, less than an amount of energy to change the phase of section 40 of the mask layer 34.

In addition, an optical stack of thin firm dielectric layers can be deposited to maximize contrast ratios of the masking layers and maximize the efficiency of the system. Since heat can diffuse through the silicone layer, it can function independent of process color because absorption of heat from the energy beam takes place in the masking layer itself.

In an embodiment, the mask layer 12 is formed of a bi-stable phase change material that has a large optical change in properties at a given heating wavelength. In addition, there can be another wavelength with high optical absorption in both phases so as to allow optical writing of the mask. As described above, $VO_2$ has a large optical contrast for infrared wavelengths between 1.0-3.0 ums between the semiconducting and metallic states. In addition, it forms a bi-stable hysteresis loop and can be reproducibly switched between the two phases over millions of switching cycles at speeds approaching femtoseconds. Typically the switching temperature is close to 67 degrees Celsius.

Figure 5:
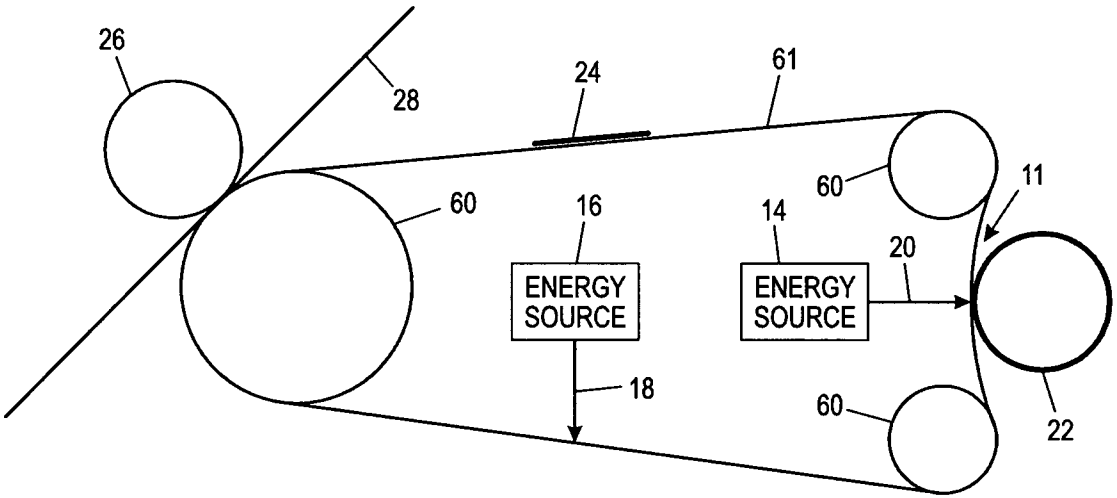
FIG. 5 is a diagram illustrating an imaging system having a tunable energy transfer characteristic according to another embodiment.

FIG. 5 is a diagram illustrating an imaging system having a tunable energy transfer characteristic according to another embodiment. Although a drum or a cylinder has been described above as a supporting substrate for the image receiving structure 10, other supporting substrates can be used. In this embodiment, the supporting substrate is a belt 61. Rollers 60 can tension the belt 61. As a result, contact with the marking material of the donor roller 22 is maintained in the nip 11. Patterned marking material can be transferred to the belt 61 similar to the transfer to the image receiving structure 10 as described above as illustrated by patterned marking material 24. The patterned marking material 24 can then be transferred to the substrate 28 by impression roller 26.

The belt 61 can have a cross-section similar to that described with reference to FIG. 2. However, in this embodiment, the supporting substrate 36 of FIG. 2 would be material of the belt 61. In an embodiment, a material of the belt 61 has high strength, high tear and scratch resistance, low cost, and is optically transparent over the wavelength range of the energy sources used for heating and/or patterning. For example, optically clear polyethylene terephthalate can be used as a belt material as it is transparent over a wavelength range from about 600 nm-1100 nm.

The deposition of the mask layer of the belt 61 can be performed similar to techniques described above. For example, a nanoparticle liquid suspension of $VO_2$ can be dip coated over the belt. Similar techniques can be used to apply the outer layer as described above.

Due to the belt geometry, the space limitations of fitting a laser raster scanning system, line image projection optics, or the like within a drum 9 as described above can be alleviated. Routing of the belt 61 can allow more internal access to the nip region. As a result, first and second energy sources 16 and 14 can be disposed within the belt 61.

Figure 6:
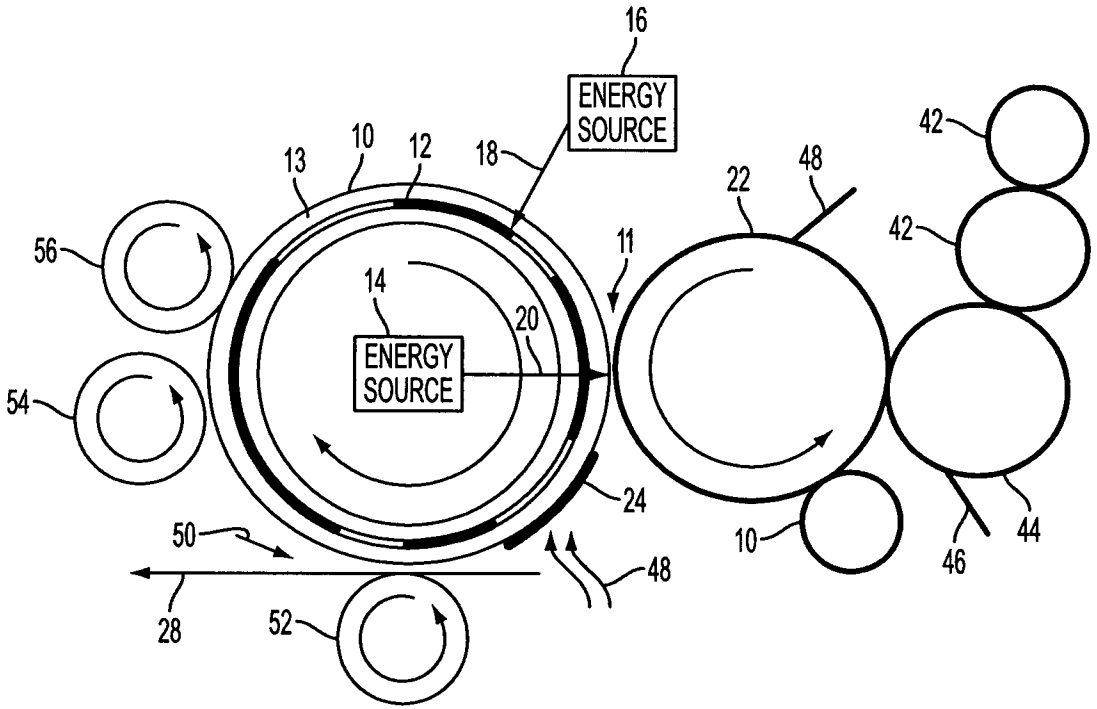
FIG. 6 is a diagram illustrating an imaging system having a tunable energy transfer characteristic according to another embodiment.

FIG. 6 is a diagram illustrating an imaging system having a tunable energy transfer characteristic according to another embodiment. The imaging system has elements similar to FIG. 1. In this embodiment, the image receiving structure 10 is an imaging roller. The donor structure 22 is a donor roller. Forming rollers 42 can be used to apply marking material to an anilox roller 44. Doctor blade 46 shapes the marking material on the anilox roller 44.

Accordingly, marking material can be metered onto a donor roller. In an embodiment, the marking material can be metered using a 'keyless' marking material metering system. Such a marking material metering system does not require adjustment of the marking material flow based upon the image coverage area and can be used with waterless marking materials. The doctor blades 46 and 48 can be used to control the thickness and uniformity of the marking material.

Once a substantially uniform marking material layer has been formed on the donor roller, the marking material can be rotated into the nip 11 were it can be heated as described above by the second energy source 14. In an embodiment, the image roller can include glass as a substrate and silicone as an outer layer. In order for the second energy beam 20 to reach the marking material the image roller can have a wavelength transmission window over which little absorption occurs. Since silicone can have a narrower transmission window, it can limit the selection of the second energy source 14. For example, the second energy source can be a laser that emits in the red and/or near infrared spectrum, within a wavelength range of relatively higher transmission in silicone.

A cooling source can cool the patterned marking material 24. For example, cool air 48 can be directed towards the patterned marking material 24. As a result, the patterned marking material 24 that was heated to adhere to the image receiving structure 10 can be cooled to reduce the adhesion to the image receiving structure 10. Since the patterned marking material 24 is not in contact with a surface other than a surface of the image receiving structure 10, even with the lowered adhesion, it will still adhere to the image receiving structure 10. However, when brought in contact with the substrate 28, the patterned marking material 24 can adhere to the substrate 28. As described above, the marking material can be removed from a silicone surface with near 100% efficiency. As a result, a substantial amount of the patterned marking material 24 is transferred to the substrate 28.

In an embodiment, an air knife 50 can be used to separate the substrate 28 from the image receiving structure 10. Although the adhesion of the patterned marking material 24 to the substrate may be greater than the adhesion to the image receiving structure 10, the adhesion of the marking material to the image receiving structure 10 can cause the substrate 28 to adhere to the image receiving structure 10. In particular, if the substrate is a single page of paper, for example, the leading edge of the paper may follow the image receiving structure 10 up towards the cleaning roller 54. Accordingly, the air knife 50 can separate the substrate from the image receiving structure 10. Alternatively, or in addition, the substrate 28 can be held under tension to separate it from the image receiving structure 10.

Although close to 100% of the patterned marking material 24 can transfer to the substrate, some portion can remain. If left on the image receiving structure 10, the remaining marking material can cause ghosting in subsequent imaging operations. Accordingly, a cleaning roller 54 and a conditioning roller 56 can be used to prepare the image receiving structure 10.

Although forming rollers, doctor blades, anilox rollers, conditioning rollers, cleaning rollers, and the like have been described above, such systems need not be identical to those illustrated in FIG. 6. In an embodiment, any system that can form a substantially uniform layer of marking material by the time the marking material is in the nip 11 can be used. Similarly, any conditioning system that removes marking material from the image receiving structure 10 can be used.

Figure 7:
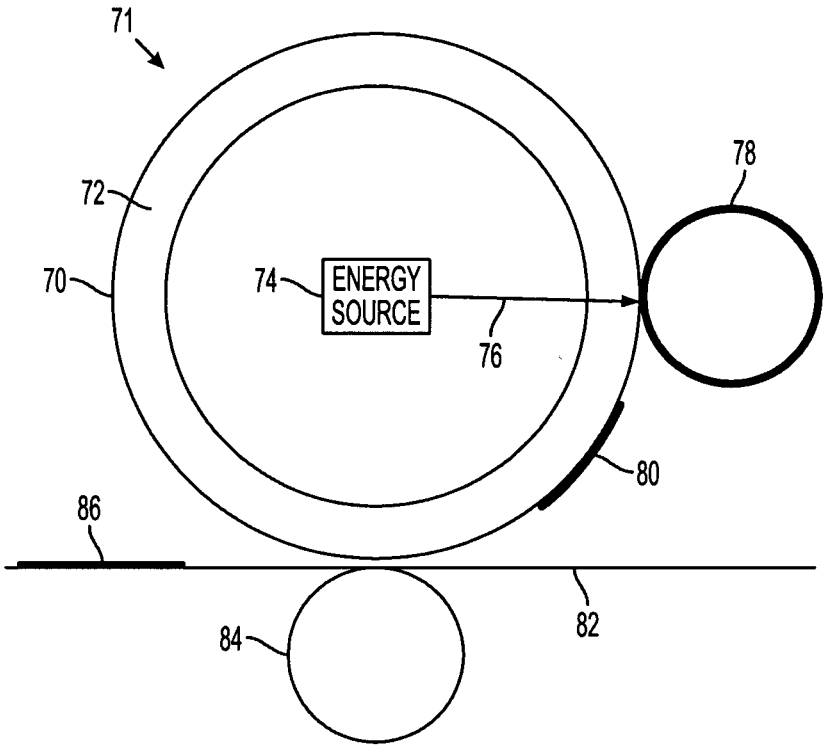
FIG. 7 is a diagram illustrating an imaging system having a pattern-wise modulated energy beam according to another embodiment.

FIG. 7 is a diagram illustrating an imaging system having a tunable energy transfer characteristic according to another embodiment. The imaging system 71 includes a donor structure 78, an image receiving structure 72, and an energy source 74. The donor structure 78 is configured to receive a layer of marking material. As described above, a variety of systems can be used to form the marking material on the donor structure 78.

The image receiving structure 72 is disposed in direct contact with the marking material. In particular, an outer layer 70 of the image receiving structure 72 is in direct contact with the marking material. As described above, the outer layer 70 can be a siloxane such as silicone.

The energy source 74 is configured to emit a pattern-wise modulated energy beam 76 at a region of the image receiving structure contacting the marking material on the donor structure. As a result, the marking material on the donor structure 78 is pattern-wise transferred to a surface of the image receiving structure 72.

In an embodiment, the region of the image receiving structure 72 contacting the marking material at which the pattern-wise modulated energy beam is directed is offset from a minimum distance point between the image receiving structure 72 and donor structure 78. In an embodiment, the region is offset from an axis formed by a focus of the donor structure and a focus of the image receiving structure. In another embodiment, the region can be offset from a point of minimum distance between the image receiving structure 72 and the donor structure 78.

An impression roller 84 can bring the substrate 82 in contact with the patterned marking material 80 transferred to the image receiving structure 72. Accordingly, patterned marking material 86 can be transferred to the substrate 82.

Figure 8:
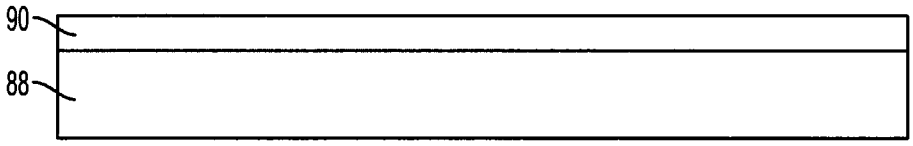
FIG. 8 is a cross-sectional view of an image receiving structure of FIG. 7.

FIG. 8 is a cross-sectional view of an image receiving structure of FIG. 7. In this embodiment, the image receiving structure 72 need not have a layer with tunable energy transfer characteristics as described above. In contrast, the energy source 74 is modulated to create the pattern-wise heat transfer to the marking material. Accordingly, the image receiving structure 72 can include a substrate 88 and an outer layer 90. The outer layer can be silicone, as described above.

Figure 9:
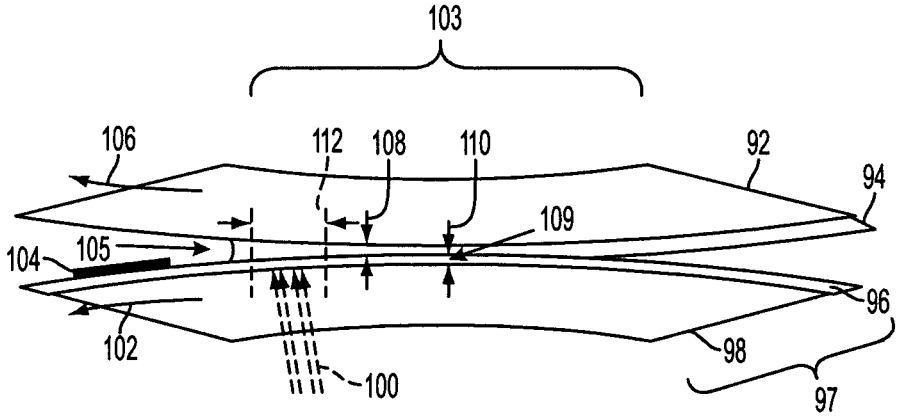
FIG. 9 is a cross-sectional view of a nip according to an embodiment.

FIG. 9 is a cross-sectional view of a nip according to an embodiment. In an embodiment, the energy can be deposited in the nip region between the donor and imaging surfaces 92 and 97 such that the heat does not have time to diffuse. If the heat does have time to diffuse, the desired image can be washed out. Distance 110 is the thickness of the silicone layer 96. Distance 108 is the thickness of the marking material 94 in the nip. The thickness 108 is a minimum where the donor structure 92 and image receiving structure 97 are at their closest at location 109. Arrow 102 indicates a direction of rotation of the image receiving structure 98. Arrow 106 indicates a direction of rotation of the donor structure 92. Energy beam 100 is directed at a location 112 offset from location 109. That is, the energy beam 100 is offset from the location where the image receiving structure 92 and the donor structure 92 are the closest at location 109. Whether a image-wise modulated source is used as in the embodiment discussed in FIG. 7 or a tunable masking layer is used to selectively transmit or absorb heat the nip region in an image wise fashion as in the embodiment discussed in FIGS. 1-6, in an embodiment, the optimal location of the heated line will be offset from the location 109 at the location 112.

Figure 10:
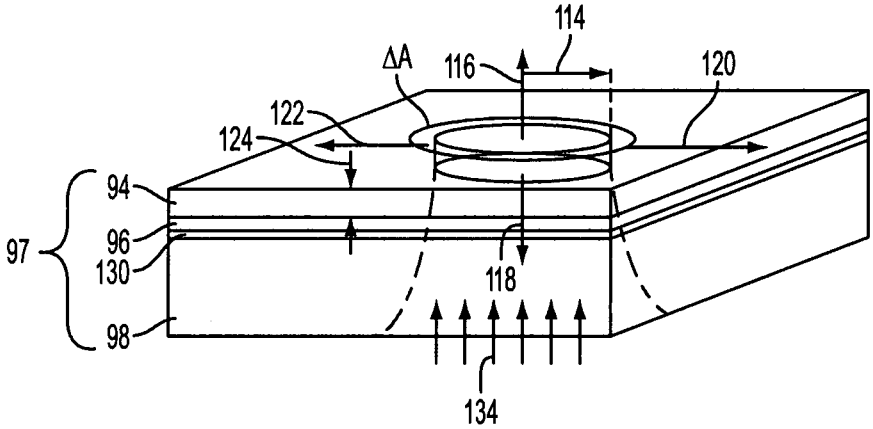
FIG. 10 is an isometric view of heat dissipation in the marking material in FIG. 9.

FIG. 10 is an isometric view of heat dissipation in the marking material in FIG. 9. In this view, a mask layer 130 is illustrated between the substrate 98 and the silicone later 96. This view illustrates the conduction of heat from the point of application and applies to direct heating by an energy beam 100 as well as to indirect heating as described above, with or without a mask layer 130. Accordingly, the mask layer 130 is added for illustration, by may not be present for some applications.

Referring to both FIGS. 9 and 10, in an embodiment, for high resolution imaging to occur, the selectively heated marking material should transfer to the silicone 96 at the exit point of the nip in a time period less than the lateral thermal diffusion time constant or image blurring can occur. Accordingly, the heat spreading area $\Delta A$ can be a fraction of the laser illuminated area with radius 114. In addition, the overall diffusion rate of heat in both the vertically and lateral directions should not be so fast so as to allow the marking material to cool down before it has a chance to split at the exit 105 of the nip 103.

As the location 112 is moved further away from the exit 105 of the nip 103, heat will have a longer time to diffuse and the temperature of the marking material 94 will have a longer time to decrease from its peak value. Thus, in an embodiment, the energy beam 100 can be focused in a region close to the exit 105 of the nip 103. However, if the laser is focused too close to the nip exit, such that the marking material 94 has already partially lifted off the silicone 96, then a non-uniform transfer can occur.

Accordingly, the region of the image receiving structure contacting the marking material at which the pattern-wise modulated energy beam is directed can be offset from the axis towards an exit from a nip between the donor structure and the image receiving structure. As a result, the marking material 94 will have less time to cool as it moves to the exit 105 of the nip 103. In addition, the region of the image receiving structure contacting the marking material at which the pattern-wise modulated energy beam is directed can be offset from the exit 105 from the nip 103.

Furthermore, the marking material 94 can be thinner than the width of the heated location 112. As a result, splitting dynamics of the marking material for one pixel can be isolated from the dynamics of neighboring pixels. Typical waterless offset inks can be put down on paper in a thickness range of about 0.5 to 1.0 micron. Accordingly, at a resolution of even 1200 dpi (21 ums spacing), there is still about a 1:20 ratio between the marking material 94 thickness and the nearest neighbor pixel.

A time constant for thermal diffusion can be estimated from marking material parameters. At an imaging resolution of 600 dpi, the laser beam waist for a heated pixel region is on the order of 42 ums in diameter. As described above the marking material thickness 108 is no more than about a few microns thick. Because the marking material thickness 108 is much less than the width of the energy beam, for conducted heat, vertical diffusion of heat dominates the overall cooling time constant. That is, heat diffusion can occur in directions 120 and 122; however, more heat will be transferred in directions 116 towards the donor structure 92 or in direction 118 towards the image receiving structure 97.

The thermal conductivity of the silicone depends on the formulation. For example, for a native PDMS material without modified chemistry, the thermal conductivity, $\kappa_{PDMS}$, is expected to be close to the range of 0.15-0.2 W/m-K. While the exact specific heat and thermal conductivity of waterless inks as marking materials vary from one formulation to another, typical values can be used to give order of magnitude calculations. Typical thermal values for the high molecular weight oils used in waterless inks are a specific heat $c_\rho$~2000 J/kg-K, a mass density of $\rho_{ink}$~1.0 gm/cc, and a thermal conductivity $\kappa_{ink}$~0.15 W/m-K. Finally, in order to efficiently absorb the laser light, the laser absorption depth should be on the order of a few microns. Given that vertical conduction dominates the loss of heat, the expected thermal time constant can be estimated from a scaling relation in equation 1:

$$t_d = c_\rho * \rho_{ink} * d^2 / \kappa_{PDMS} \quad 1)$$

d is on the order of the absorption depth thickness of the marking material in the nip. For the typical values stated, the diffusion time, $t_d$ is on the order of 100 us assuming d=2-3 um as the overall absorption depth. In contrast, the time constant for lateral heat diffusion through the ink is expected to be on the order of 1 ms due to the fact the heat has to travel through 42 ums. For print speeds of 100 ppm, the linear feed rate of the printer is on the order of ~0.5 m/s. This speed results in the energy beam location 112 being positioned to within approximately 50 microns of the exit 105 of the nip 103. As the imaging speed is increased, this requirement can be relaxed somewhat due to the larger distance over which the rollers travel within a given thermal time constant.

In an embodiment, the donor structure 92 has a thermal conductivity less than a thermal conductivity of the marking material. For example, the donor structure 92 can be made out of a low thermal conductivity material that is compatible with most UV inks. An Ethylene Propylene Diene Monomer (EPDM) coated roller is can be used with UV curable inks and with a thermal conductivity in the neighborhood of about 0.3 W/m-K. Accordingly, the heat transfer to the donor structure 92 can be reduced.

Referring back to FIG. 7, in an embodiment, energy source, 74 can be a raster scanned high power laser beam if there is sufficient room to house the optics. Although an imaging cylinder was used depicted in FIG. 7 it also possible for a belt configuration to be used similar to the configuration depicted in FIG. 5. A belt configuration allows more room for a raster scanning system. For example, the laser spot could be scanned in a raster like fashion across the nip near the exit using polygon scanners. Based upon the volume of marking material heated and its specific heat capacity, the energy needed to raise the temperature of the marking material to least 50 C. is on the order of 1 uJ. This amount of thermal energy must be delivered over a very short dwell time per pixel. For a 14 inch wide media at 600 dpi imaging resolution, and a line speed of 10 kHz, the pixel dwell time is only on the order 10 ns resulting in a laser power of approximately 100 W. This typically corresponds to speeds slightly greater than 100 ppm.

In another embodiment, finer grayscale control over the spot width may be needed. For example, the a xerographic imaging with 600 dpi×600 dpi×8 bit resolution typically achieves 8 bits of grey scale by stretching of the addressed spot size out into finer addressable increments than the spot width. Accordingly, the laser can be modulated during the raster scan at rates corresponding to fractional distances of the laser spot diameter. This implies the modulation speed would be closer to 1 ns in order to achieve such grey scale resolution.

The energy source 74 can be a high power lasers that is externally modulated using electro-optic Pockell cells, acousto-optic modulators (AOMs), or the like. However, for some applications, a higher modulation rate may be needed. The energy source 7 can be a fiber laser operating near wavelengths in the range of 0.9-1.1 um. Such fiber lasers have been able to surpass such levels of power.

In addition, some polygon scanners are capable of rotating at such high speeds. For example, xerographic raster scanning systems employ multi-spot laser raster scanning optical system (a multi-spot ROS) which allows several lines of the image to be scanned at once as a polygon scanner rotates and allows the polygon scanner to rotate at a lower speed with more precision. Furthermore, this allows the data stream to be broken down into parallel data pipes of manageable bandwidths as well as allowing the use of polygon scanners that do not become prohibitively expensive. This approach can be used if the tolerance for the laser spot location is large enough to accommodate multiple lines without affecting marking material transfer characteristics due to heat diffusion.

The energy source 74 may also be a line generated laser source which is externally modulated by a linear spatial light modulator array. For example, the line generated source may consist of horizontally stacked laser diode sources.

Another embodiment includes an article of machine readable code embodied on a machine readable medium that when executed, causes the machine to perform any of the above described operations. As used here, a machine is any device that can execute code. Microprocessors, programmable logic devices, multiprocessor systems, digital signal processors, personal computers, or the like are all examples of such a machine.

Although particular embodiments have been described, it will be appreciated that the principles of the invention are not limited to those embodiments. Variations and modifications may be made without departing from the principles of the invention as set forth in the following claims.

What is claimed is:

1. An imaging system, comprising:

an image receiving structure including a material having a tunable energy transfer characteristic configured to pattern-wise mask a transmission of energy from the energy source to the marking material;

an energy source to emit an energy beam at the material having the tunable energy transfer characteristic such that marking material is pattern-wise transferred to a surface of the image receiving structure; and a second energy source to emit an energy beam at the image receiving structure, the second energy source selected to pattern-wise tune the energy transfer characteristic of the marking material.

2. The imaging system of claim 1, further comprising:

a donor structure to receive a layer of marking material;

wherein the image receiving structure further comprises:

a first layer including the material having the tunable energy transfer characteristic; and a second layer disposed between the first layer and the donor structure.

3. The imaging system of claim 1, wherein the image receiving structure comprises a layer including a siloxane material.

4. The imaging system of claim 1, wherein the material having a tunable energy transfer characteristic includes a bi-stable phase change material.

5. The imaging system of claim 1, wherein the tunable energy transfer characteristic of the material is defined by a tunable transmittance, the material including at least one of a thermochromic material and a photochromic material.

6. The imaging system of claim 1, wherein:

the material having the tunable energy transfer characteristic has a first transmittance in a first state and a second transmittance in a second state; and the first transmittance is less than the second transmittance.

7. The imaging system of claim 1, wherein:

the material having the tunable energy transfer characteristic has a first absorbance and a first reflectance in a first state and a second absorbance and a second reflectance in a second state;

the first absorbance is less than the second absorbance; and the first reflectance is higher than the second reflectance.

8. An imaging system, comprising:

an image receiving structure disposed to be in direct contact with a marking material; and an energy source to emit a pattern-wise modulated energy beam at a region of the image receiving structure contacting the marking material to pattern-wise transfer marking material to the image receiving structure, wherein the region of the image receiving structure contacting the marking material at which the pattern-wise modulated energy beam is directed is offset from a minimum distance point between the image receiving structure and a donor structure towards an exit from a nip between the donor structure and the image receiving structure.

9. The imaging system of claim 8, further comprising:

a cooling system to cool the marking material transferred to the image receiving structure prior to contacting a substrate.

10. The imaging system of claim 8, wherein the region of the image receiving structure contacting the marking material at which the pattern-wise modulated energy beam is directed is offset from the exit from the nip.

11. The imaging system of claim 8, wherein the energy source is configured to emit the pattern-wise modulated energy beam such that an amount of energy delivered to the marking material is less than an amount of energy to change a phase of the marking material.

12. A method of imaging, comprising:

pattern-wise tuning a tunable energy transfer characteristic of a material of an image receiving structure;

selectively transferring marking material to the image receiving structure according to the energy transfer characteristic of the material; and selectively modifying viscoelastic properties of the marking material using the material of the image receiving structure as a mask.

13. The method of imaging of claim 12, further comprising:

pattern-wise transferring thermal energy to the material of the image receiving structure; and transferring at least part of the thermal energy of the material to the marking material.

14. The method of imaging of claim 12, further comprising:

irradiating the image receiving structure with an energy beam; and pattern-wise transmitting at least part of the irradiation incident on the image receiving structure to the marking material.

15. The method of imaging of claim 12, further comprising:

pattern-wise changing at least one of a transmittance, an absorbance, and a reflectance of the material of the image receiving structure.

16. An imaging system, comprising:

an image receiving structure including a material having a tunable energy transfer characteristic configured to pattern-wise absorb energy from the energy source and indirectly transfer at least a part of the energy to the marking material through heat conduction;

an energy source to emit an energy beam at the material having the tunable energy transfer characteristic such that marking material is pattern-wise transferred to a surface of the image receiving structure; and a second energy source to emit an energy beam at the image receiving structure, the energy source selected to pattern-wise tune the energy transfer characteristic of the marking material.

* * * * *

UNITED STATES PATENT AND TRADEMARK OFFICE

CERTIFICATE OF CORRECTION

PATENT NO. : 8,487,970 B2
APPLICATION NO. : 12/245578
DATED : July 16, 2013
INVENTOR(S) : Timothy D. Stowe et al.

It is certified that error appears in the above-identified patent and that said Letters Patent is hereby corrected as shown below:

In the Specification

Column 2, line 6, the words “manor” should be replaced with --manner--.
Column 3, line 22, the words “roll” should be replaced with --role--.

Signed and Sealed this
Twenty-ninth Day of October, 2013

Teresa Stanek Rea
*Deputy Director of the United States Patent and Trademark Office*